US006186465B1

(12) United States Patent
Clark

(10) Patent No.: US 6,186,465 B1
(45) Date of Patent: Feb. 13, 2001

(54) BOOK DISPLAY APPARATUS

(76) Inventor: Stephen Clark, Apt. 211 - 71 Glamis Drive SW, Calgary (CA), T3E 6S4

( * ) Notice: Under 35 U.S.C. 154(b), the term of this patent shall be extended for 0 days.

(21) Appl. No.: 09/383,627

(22) Filed: Aug. 26, 1999

Related U.S. Application Data

(60) Provisional application No. 60/098,143, filed on Aug. 27, 1998.

(51) Int. Cl.[7] ..... A47B 5/04

(52) U.S. Cl. ..... 248/444.1; 40/792; 40/794; 40/726

(58) Field of Search ..... 40/792, 794, 800, 40/726; 248/444.1, 444.3

(56) References Cited

U.S. PATENT DOCUMENTS

| | | | | |
|---|---|---|---|---|
| 231,473 | * | 8/1880 | Brower | 40/792 |
| 605,959 | * | 6/1898 | Henderson | 248/444.3 |
| 1,388,010 | * | 8/1921 | Watson | 40/794 |
| 1,438,181 | | 12/1922 | Klopf . | |
| 1,882,157 | | 10/1932 | Minton . | |
| 2,649,799 | | 9/1953 | Spertus . | |
| 2,689,060 | | 9/1954 | Katzman . | |
| 3,286,382 | | 11/1966 | Newman . | |
| 3,350,150 | * | 10/1967 | Schwarm | 248/444.3 |
| 3,589,049 | | 6/1971 | Cornelius . | |
| 3,807,071 | | 4/1974 | Candor . | |
| 5,421,111 | | 6/1995 | Primm . | |

* cited by examiner

*Primary Examiner*—Cassandra H. Davis
(74) *Attorney, Agent, or Firm*—Bennett Jones LLP

(57) ABSTRACT

A book display apparatus comprises a backplate, a clear cover panel and a decorative frame. Two separate book tensioners are provided to bias the two halves of an open book against the clear cover panel.

6 Claims, 2 Drawing Sheets

BOOK DISPLAY APPARATUS

CROSS REFERENCE TO RELATED APPLICATION

This application claims the priority benefit of U.S. Provisional Application No. 60/098,143 filed on Aug. 27,1998.

FIELD OF THE INVENTION

The present invention relates to an apparatus for displaying an open book and in particular to an apparatus which will display a book within a decorative picture frame.

BACKGROUND OF THE INVENTION

It is sometimes desirable to display an opened book to display artistic or photographic images or text within the book. For example, a book may contain reproductions of artwork which the owner may wish to display by mounting the book to a frame and hanging the frame on a wall, in the same manner paintings or posters may be framed and hung.

In U.S. Pat. No. 1,438,181 issued to Klopf, there is disclosed a book container which is designed to display an open book in a horizontal position. It is specifically designed to be a cookbook holder and includes a cover to prevent spattering of foodstuffs on the book. The book is held open to the proper page by wire clips visible from the front. This book container is also intended to store cakes and breads after the cooking process. Therefore the container is of a size which is not suitable for displaying the book.

In U.S. Pat. No. 2,649,799 issued to Spertus, there is disclosed a picture-frame album intended to allow display of photographs mounted in album. This frame however could not display open books unless the spine of the book was destroyed. It is only suitable for the display of single flat pages such as a photograph or a photo album which could be folded flat.

Although the history of printed and bond books dates back to the $15^{th}$ century, there has been no known method of conveniently and attractively displaying an open book, particularly with a protective cover and in a vertical orientation.

Therefore, there is a need in the art for a convenient method and apparatus of displaying an open book in a vertical orientation which overcomes the shortcomings of the prior art.

SUMMARY OF THE INVENTION

In general terms, the invention comprises a book display apparatus which allows an open book to be displayed vertically as an artistic work within a decorative frame. The apparatus may be hung from a wall and allows for the fact that an open book has two halves, one of which may be significantly thicker than the other. For example, if a book is opened to a page near the beginning, the right hand half of the open book will be significantly thicker than the left hand half. The apparatus comprises two book tensioners which are separately adjustable and which bias the book flat against the front of the apparatus Therefore, the book display apparatus comprises:

a) a backplate including means for hanging the backplate from a wall;

b) a clear cover panel adapted to engage the backplate so as to enclose an open book there between; and c) first and second book tensioners associated with the backplate for pressing each half of the open book up against the inside of the clear cover panel.

Optionally, a decorative frame which borders the cover panel may be provided.

In the preferred embodiment, the book tensioning means are two separate steel bands or clips which have a fixed end and a sliding end. By moving the sliding end towards the fixed end, the clips may be made to bulge, thereby biasing the book against the cover panel. One skilled in the art will be able to conceive of many specific book tensioners which are not specifically disclosed herein but are encompassed by the claims below. For instance, two separate inflatable bladders may be provided on each side in order to bias the two halves of the book against the cover. The specific mechanism by which the book tensioners is not essential to the invention, what is essential is that the left and right book tensioners be separately and adjustably expandable in order to accomplish this function.

A ledge may be provided to rest the book on, which ledge may be adjustable vertically in order to center the book within the apparatus.

BRIEF DESCRIPTION OF THE FIGURES

The invention may be described by way of an exemplary embodiment with reference to the accompanying simplified, diagrammatic, out-of-scale drawing.

DETAILED DESCRIPTION OF THE PREFERRED EMBODIMENT

Figures 1, 1A:
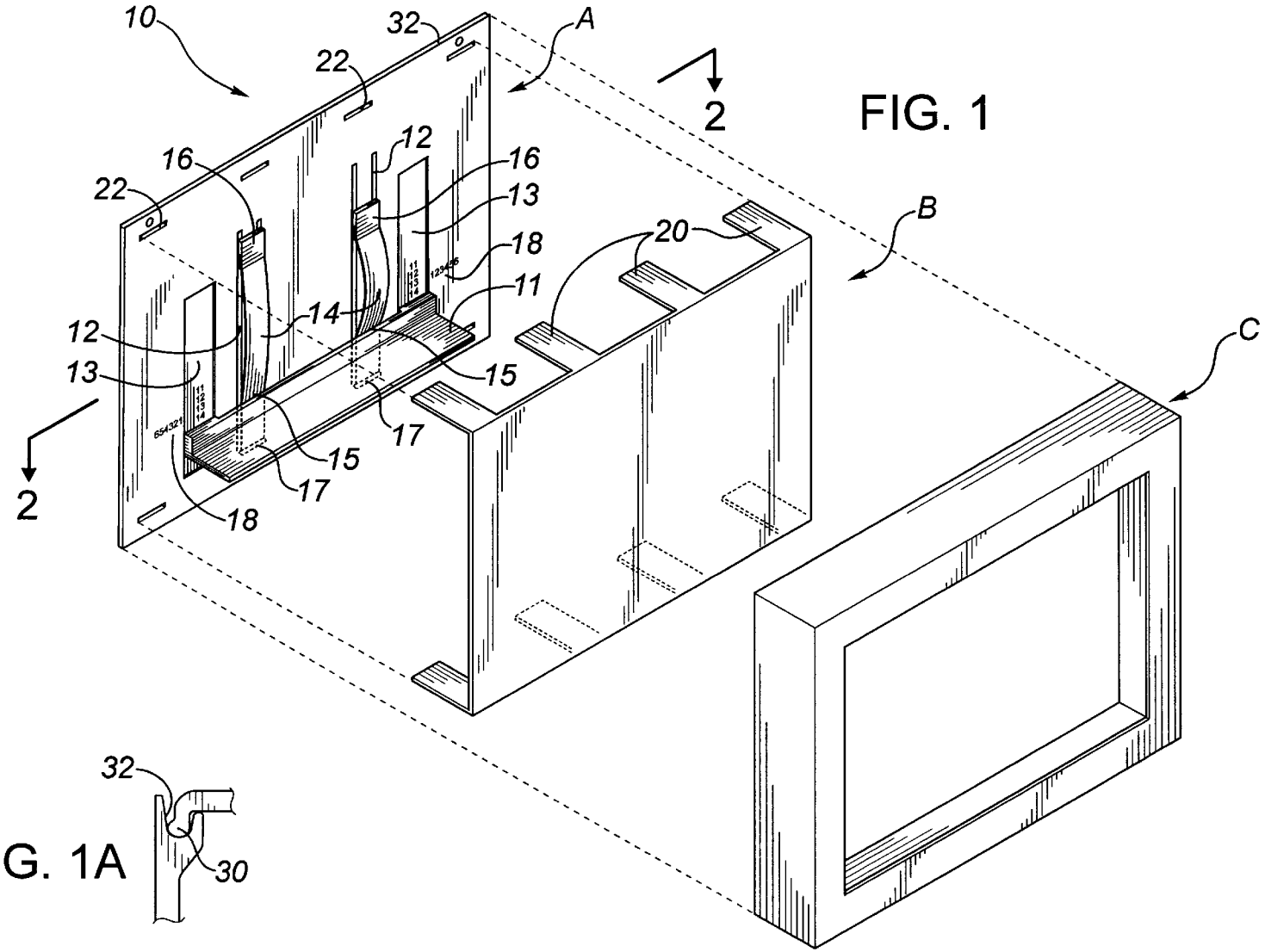
FIG. 1 is an exploded isometric view of a preferred embodiment of the invention.
FIG. 1A is a cross-sectioned detail of the hinge
Figure 2:
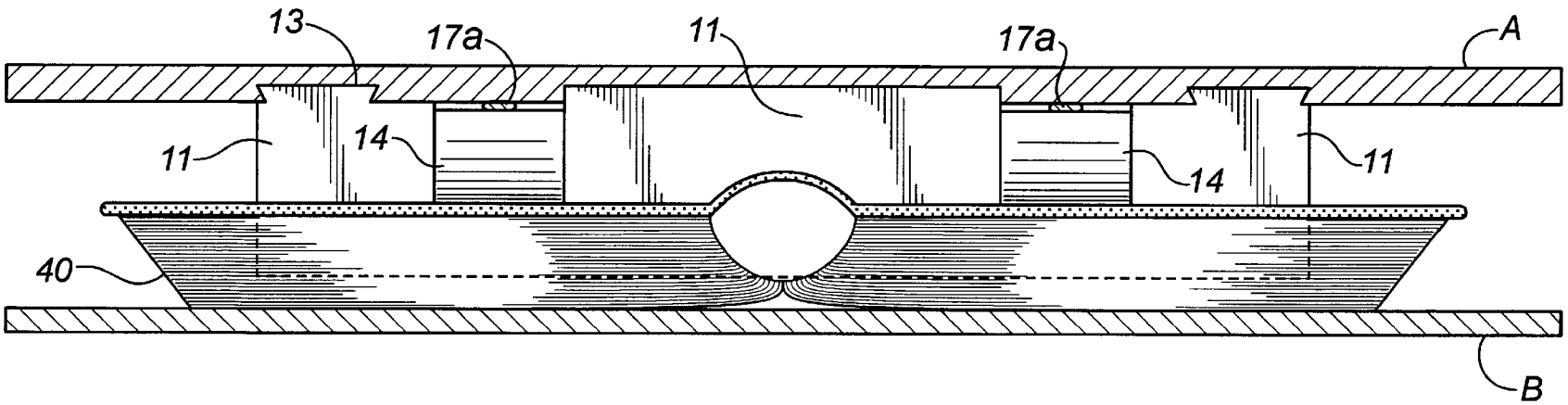
FIG. 2 is a cross-sectional view of the preferred embodiment.

According to FIG. 1, the preferred embodiment of the book display apparatus (10) comprises a backplate (A), a clear cover panel (B) and a decorative frame (C).

The backplate may be constructed of wood, injection molded plastic or any other suitable construction. It is designed to vertically support an open book and also to provide means to hang the assembled apparatus on a wall. The backplate includes a horizontal ledge (11) upon which the open book may rest. In the preferred embodiment, the ledge engages two parallel vertical tracks (13) by a tongue and groove configuration which allows the ledge to slide vertically within the apparatus. This vertical movement permits the centralization of the book within the apparatus.

The backplate also includes left-hand and right-hand spring clips (14) which are designed to push the open book forward against the cover panel. Each spring clip (14) is preferably a flat flexible band of steel and has one end (15) fixed to the backplate. The other end (16) may slide along a vertical track (12) upon activation by the handle (17) which is directly connected to the sliding end by means of a push/pull rod **(17*a*) behind the spring clip (14). The handle (17) is readily accessible from the bottom of the backplate/coverplate assembly. When the sliding end is moved closer to the fixed end, the clip (14)** will bulge outward, thereby pushing the open book forward against the cover panel. The sliding end and the track may be provided with matching cogs or teeth which may be disengaged to permit movement and engaged to secure the sliding end in position.

Each clip may be separately adjusted to account for variations in thickness between the two sides of the open book.

The backpanel may be provided with markings (18) to assist in centering the book within the apparatus, both vertically and horizontally.

The clear cover panel (8) may be constructed of plexiglass or some other clear rigid material. It is preferable that the material be relatively scratch proof and shatter proof. The cover panel engages the back panel by means of tabs (20) which insert into matching slots (22) along the periphery of the backplate. In the preferred embodiment, the clear cover panel is permanently attached to the back panel, by gluing the tabs (20) into place, thus facilitating the mounting of a book within the apparatus (10). However, it is foreseeable that one may construct the apparatus such that the cover panel is removable.

The length of the tabs (20) dictates the width of the space between the backplate (A) and the cover panel (B). In an optional embodiment, this width may be adjustable to accommodate thinner or thicker books.

The decorative frame (C) is not essential to the invention, however it may be aesthetically pleasing. In a preferred embodiment, it is designed to slide over the cover panel and cover the exposed sides, top and bottom of the backpanel/cover panel assembly. It may be constructed of wood, aluminum, plastic or any other suitable material. In the preferred embodiment, the decorative frame and the backplate are hinged together along the top edge. The hinge allows the decorative frame to conveniently disengage from the backplate. As shown, the hinge comprises a cylindrical projection (30) which engages an elongate groove (32) in the backplate. When the decorative frame is lifted away and upwards from the backplate, the projection automatically disengages from the groove, thereby freeing the decorative frame from the backplate. Preferably, the projection (30) and groove (32) are continuous along the entire upper edge of the backplate.

In operation, a book opened to the desired page is slid between the cover panel and back panel. The book is positioned to rest on the ledge (11) and centered using the appropriate markings. Each spring clip (14) is adjusted by means of the handle (17) such that the facing open pages are approximately level with each other in a vertical plane and pressing up against the inside of the cover panel (B) but without excess pressure. The decorative frame (C) may then be installed by engaging the hinge and flipping the decorative frame downward so as to engage the entire backplate/coverplate assembly. The assembled apparatus may then be hung on a wall using conventional and well-known means. Alternatively, the apparatus may be laid flat for display or propped up in like manner as an ordinary picture frame.

The above description is intended to provide an illustration of the presently preferred embodiment of this invention. It is not desired to limit the invention to the exact construction described herein. Accordingly, modifications of this invention that are apparent to those skilled in the art fall within the scope of this invention.

CONTEMPLATION OF THE INVENTION

The embodiments of the invention in which an exclusive property or privilege is claimed are defined as follows:

1. An apparatus for displaying an open book comprising:

(a) a backplate including a horizontal ledge upon which the open book may rest, wherein said horizontal ledge is movable vertically so as to permit vertical centralization of the open book within the apparatus;

(b) a clear cover panel adapted to engage the backplate so as to enclose the open book there between; and (c) first and second book tensioners associated with the backplate for pressing each half of the open book up against the inside of the clear cover panel.

2. The apparatus of claim 1 further comprising markers to assist centralizing the open book both vertically and horizontally.

3. The apparatus of claim 1 wherein the clear cover panel is permanently attached to the backplate.

4. An apparatus for displaying an open book comprising:

(a) a backplate having a top edge;

(b) a clear cover panel having an inside surface, an outer surface and a top edge and adapted to engage the backplate so as to enclose the open hook there between;

(c) first and second book tensioners associated with the backplate for pressing each half of the open book up against the inside of the clear cover panel, wherein each book tensioner comprises a spring clip which is a flexible band of steel having one end fixed to the backplate and the other end slidably engaging the backplate such that as the slidable end moves towards the fixed end, the band bulges outward from the backplate; and (d) a decorative frame which borders the cover panel and having a top edge, said frame removably and hingedly engaging the backplate by means of a groove along the top edge of the backplate which engages a projection along the top edge of the decorative frame.

5. The apparatus of claim 4 wherein the backplate further comprises a horizontal ledge upon which the open book may rest.

6. The apparatus of claim 5 wherein the horizontal ledge is movable vertically so as to permit vertical centralization of the open book within the apparatus.

* * * * *